United States Patent [19]

Mank

[11] Patent Number: 4,725,088

[45] Date of Patent: Feb. 16, 1988

[54] LIFTING SYSTEM

[75] Inventor: James L. Mank, High Wycombe, England

[73] Assignee: Ferranti Subsea Systems Limited, Edinburgh, Scotland

[21] Appl. No.: 884,597

[22] Filed: Jul. 11, 1986

[30] Foreign Application Priority Data

Jul. 19, 1985 [GB] United Kingdom ..... 85 18222

[51] Int. Cl.[4] ..... B66C 1/66; E21B 19/06

[52] U.S. Cl. ..... 296/90; 24/114.5

[58] Field of Search ..... 294/90, 86.15, 86.26, 294/88, 86.42, 91, 86.14, 86.33, 902, 102.1, 102.2, 103.1; 24/114.5 V, 115 RV, 115 NV

[56] References Cited

U.S. PATENT DOCUMENTS

| | | | |
|---|---|---|---|
| 965,739 | 7/1910 | Penglase | 24/114.5 |
| 2,538,043 | 1/1951 | Roy et al. | 24/114.5 |
| 3,061,356 | 10/1962 | Grundmann | 294/90 |
| 4,225,172 | 9/1980 | Marquardt | 294/86.42 |
| 4,650,235 | 3/1987 | Shaginian et al. | 294/90 |

*Primary Examiner*—James B. Marbert

*Attorney, Agent, or Firm*—Kerkam, Stowell, Kondracki & Clarke

[57] ABSTRACT

A lifting system (FIG. 3) for lifting a hanging flexible elongate member such as an umbilical 10 without disconnecting its ends comprises a foundation member 21 permanently clamped to the umbilical at a lifting point and a removable lifting member 22 suspended from winch 63 of lifting mechanism 23. The foundation member has a rigid body portion 25, including a downwardly facing shoulder 29, and a bend restrictor 26 at its upper end and the lifting member comprises a pair of hinged semicylindrical segments 40, 41 which can be joined about an upper part of the umbilical to form an annular carrier of support members 45 movable radially by hydraulic actuators 50. The lifting member is initially applied with support members withdrawn, to slide down the umbilical and past the foundation member, the support members then being brought together and the lifting member raised, engagement of the support members with shoulder 29 lifting also the foundation member and umbilical. Loading forces between umbilical and lifting means are spread over the contacting length of the foundation member and flexing of the umbilical is kept within to safe radius of curvature by the bend restrictor. The removable lifting member prevents fouling with equipment at other times and can be caused to lift from an inaccessible lifting point whilst being applied to the umbilical at a higher more accessible point.

18 Claims, 14 Drawing Figures

LIFTING SYSTEM

Figure 1A:
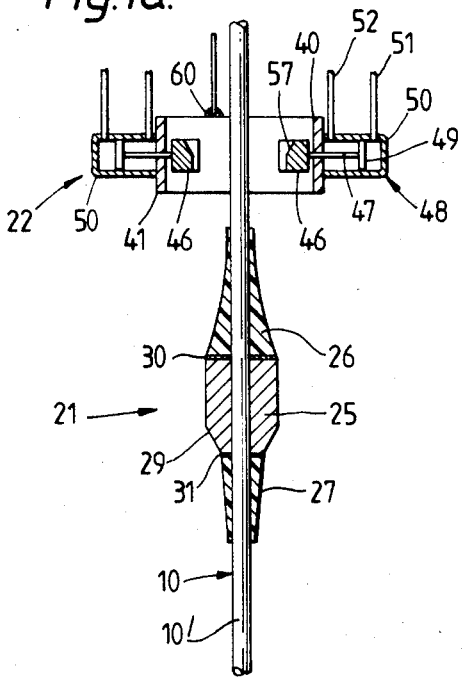

This invention relates to lifting systems and in particular to a system for lifting a flexible elongate member at an intermediate point thereon temporarily such that at other times the lifting system does not interfere with the overall flexibility or movement parameters of the member.

The invention is particularly, but not exclusively, concerned with flexible elongate members in the form of control umbilicals used in off-shore oil installations and containing channels for communicating both fluid and electrical power to sub-sea structures, such umbilicals being suspended to hang substantially vertically from a surface vessel, the flexibility of the member accommodating movements in response to forces acting thereon.

Occasionally it is required to reduce the deployed length of umbilical by raising a lower portion thereof without disconnecting the communication channels thereof.

One form of umbilical deployment, which will be described in more detail hereinafter, involves freely suspending the umbilical from an initial suspension point, such as a winch reel of the surface vessel and then lifting the suspended umbilical from a lifting point, displaced below the initial suspension point, to raise that lifting point to a heave compensation device, the lifting point then becoming a new suspension point from which that portion of umbilical below the lifting point is suspended.

It will be appreciated that the lifting point may initially be below, and not directly accessible from, a working region thereby making difficult any direct connection of a lifting arrangement to it or at the correct position. Also, the form of such lifting connection requires consideration from several other aspects. The weight and other forces associated with an elongate member, such as an umbilical, could create local loading at the lifting point, both during lifting and when it becomes a suspension point which loading could lead to structural damage to the member at the point directly applied pressure and by the introduction of excessively small radius bends through disturbing its naturally deployed shape.

It is an object of the present invention to provide a system for lifting a flexible elongate member, suspended from an initial suspension point, at a lifting point displaced from the initial suspension point and which mitigates the above difficulties.

According to a first aspect of the present invention a lifting system for a suspended flexible elongate member includes at least one foundation member, having a rigid body portion, adapted to be carried coaxially surrounding, and clamped to, the elongate member at a lifting position thereof, a removable segmented lifting member adapted to be assembled around the elongate member to form an annular apertured carrier of support means, including at least one support member movable radially outwardly in the carrier to define an open-aperture state through which the flexible elongate member and the foundation member can pass and movable radially inwardly in the carrier to define a closed-aperture state through which the flexible elongate member, but not the rigid body portion of the foundation member, can pass, and a lifting mechanism operable to lift the lifting member, with the support means in the closed-aperture state, from below the foundation member, abutment between the support means and the rigid body portion of the foundation member causing the foundation member, and a flexible elongate member to which it is clamped, to be lifted with the lifting member.

According to a second aspect of the present invention a method of lifting a suspended flexible elongate member at a lifting point below its suspension point by means of a lifting system as defined in the preceding paragraph comprises clamping a foundation member to the elongate member at a desired lifting point during deployment of the elongate member, assembling the lifting member around the elongate member at a position between the suspension point and the lifting point with the support means in an open-aperture state, sliding the lifting member down the elongate member to a position below the foundation member, causing the support means to assume a closed-aperture state and then raising the lifting member, abutment between the support means and the rigid body portion of the foundation member causing the foundation member and elongate member to be lifted with the lifting member.

Figure 1B:
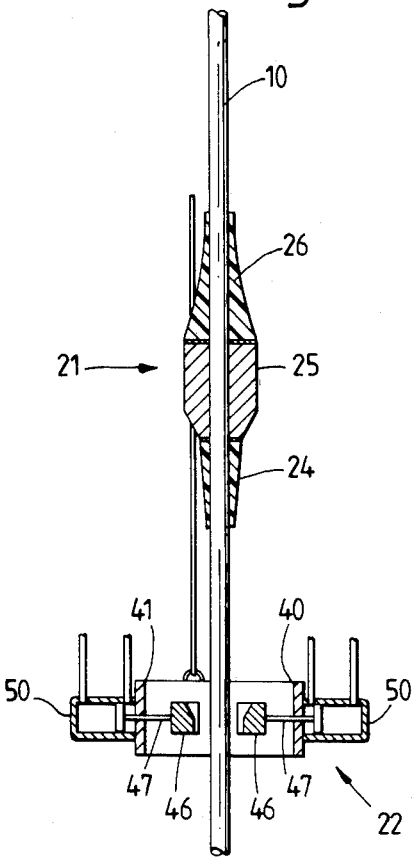
Figure 1C:
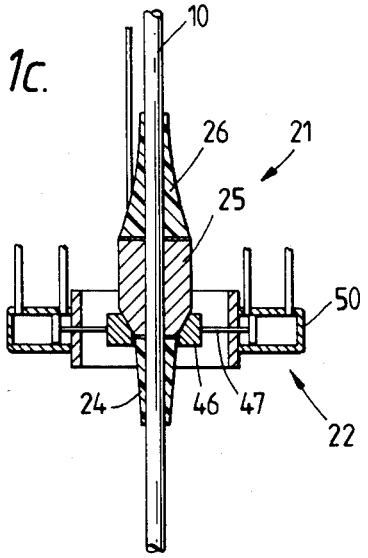
Figure 2A:
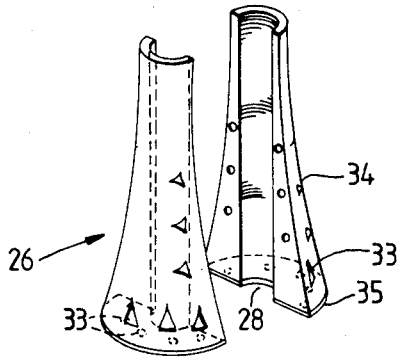
Figure 2B:
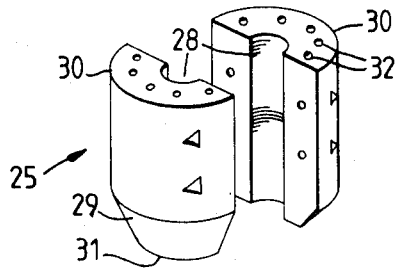
Figure 2C:
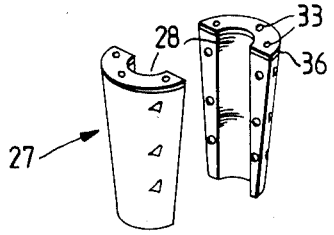
Figure 3:
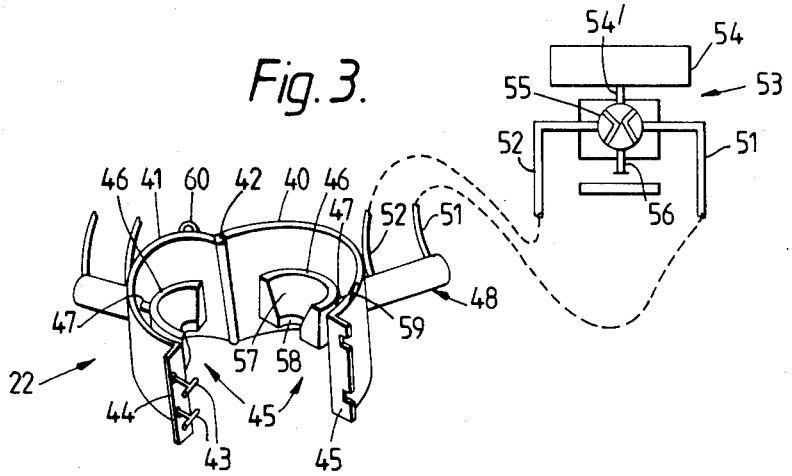
Figure 4:
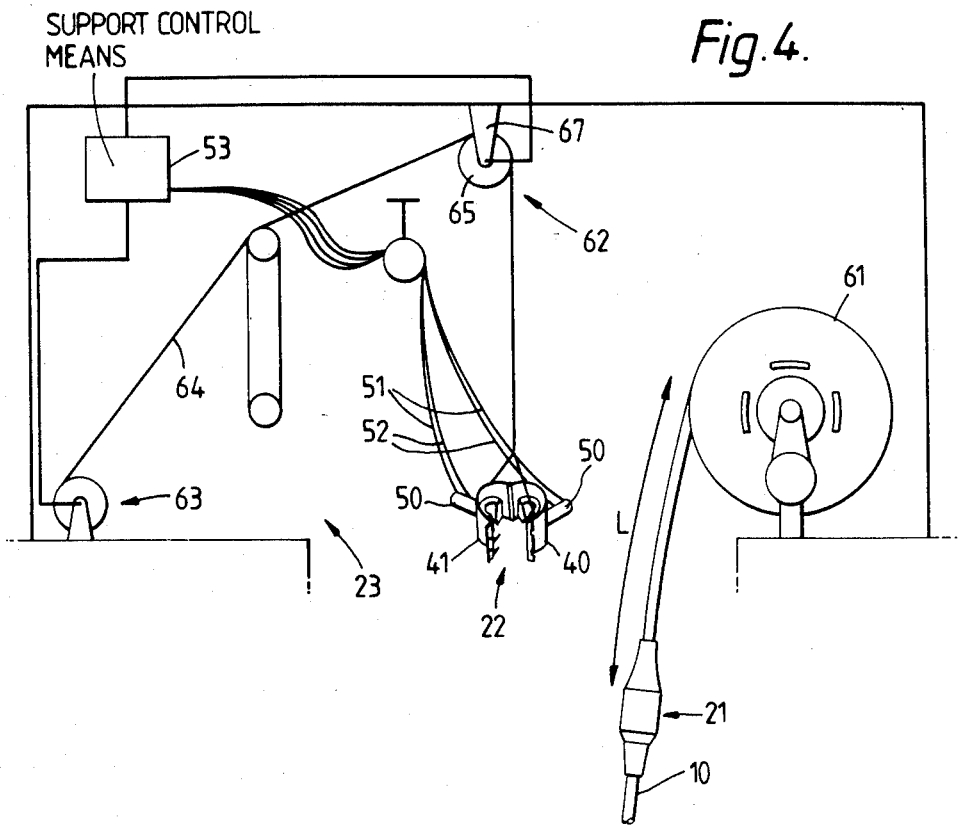
Figure 5:
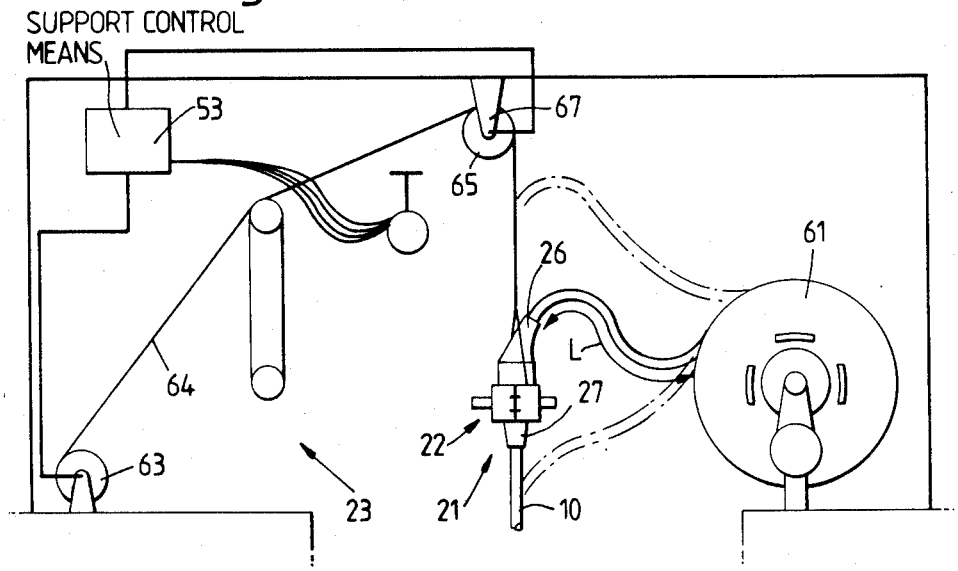
Figure 6A:
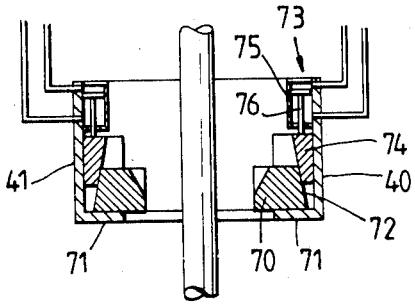
Figure 6B:
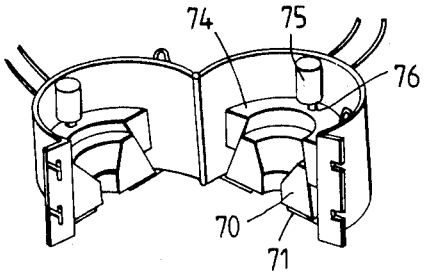
Figure 7A:
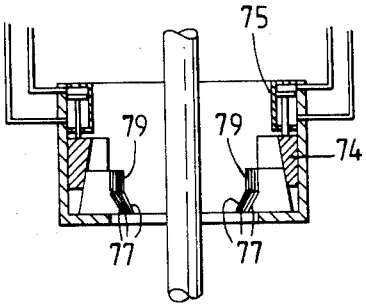
Figure 7B:
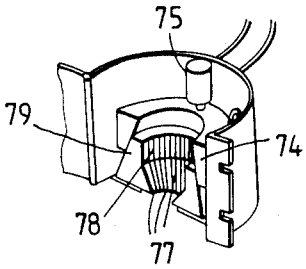

Embodiments of the present invention will now be described by way of example with reference to the accompanying drawings, in which:

FIG. 1(*a*) is a sectional elevation through a portion of a flexible elongate member in the form of a vertically suspended umbilical showing in relation thereto component parts of a lifting system according to the present invention, namely a foundation member clamped to the flexible member at a lifting point and a removable segmented lifting member assembled above the foundation member to form an annular carrier for support means shown in an open-aperture state in which the lifting member can pass the foundation member, FIG. 1(*b*) is a sectional elevation, similar to FIG. 1(*a*) but showing the lifting member below the foundation member with the support means in a closed-aperture state, FIG. 1(*c*) is a sectional elevation, similar to FIG. 1(*b*) but showing the lifting member with the support means abutting and supporting the foundation member, FIGS. 2(*a*) to 2(*c*) are perspective views of the component parts of the foundation member FIG. 2(*a*) showing a rigid body portion of the foundation member split into two component parts, FIG. 2(*b*) showing a bend restrictor, and FIG. 2(*c*) a body extension, FIG. 3 is a perspective view of the lifting member, showing support means it carries, FIG. 4 is an elevation view of an umbilical freely suspended from an initial suspension point and showing the elements of the lifting system prior to its operation, FIG. 5 is an elevation view similar to FIG. 4 but showing the umbilical lifted and suspended from the lifting system, FIG. 6(*a*) is a sectional elevation similar to FIG. 1(*b*) showing an alternative form of actuation means of the support means, FIG. 6(*b*) is a perspective view of the lifting member of FIG. 6(*a*), FIG. 7(*a*) is a sectional elevation, similar to FIG. 6(*a*) showing an alternative form of support means, and FIG. 7(*b*) is a perspective view of the lifting member of FIG. 7(*a*).

Figure 8:
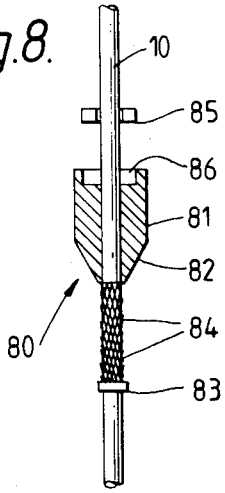

FIG. 8 is a partly sectional elevation through a portion of elongate flexible member showing an alternative form of foundation member.

Referring to FIG. 1 a vertically hanging flexible elongate member 10 comprises a control umbilical between a surface vessel and a sub-sea structure of an off-shore oil installation. The umbilical 10 is suspended from an initial suspension point (not shown) above the portion shown and hangs freely therefrom under its own weight.

The umbilical comprises a collection of electrical cables and fluid hoses contained within an outer sheath 10' communicating power and control signals between the vessel and sub-sea structure. In a typical installation the umbilical may be of the order to 125 mm diameter and 200 meters long and have to withstand tension forces therein of several tonnes as well as lateral forces from external influences, such as sea currents. To withstand such lateral forces the umbilical must be flexible in relation to its length and to withstand tension forces the sheath may include metallic reinforcement elements although such reinforcement may limit the flexibility in defining a minimum radius of curvature which must not be exceeded in umbilical flexing. Furthermore, the structure may be damaged by locally applied forces, for example due simply to the weight of an umbilical of such dimensions, if concentrated at an inadequate suspension point.

As has been indicated above it is sometimes desirable to lift the suspended umbilical from a lifting point below the inital suspension point, which lifting has to be achieved without exceeding the above outlined limitations of umbilical structure.

In accordance with the present invention the principal components of the lifting system are a foundation member 21 adapted to be clamped to the umbilical when it is first deployed and carried thereby throughout the deployment, a removable lifting member 22 and a lifting (and lowering) mechanism 23 for the lifting member (shown in FIGS. 4 and 5).

Considering first the foundation member 21, this is shown in sectional elevation in FIG. 1(*a*) and in exploded perspective view in FIGS. 2(*a*) to (*c*). The foundation member 21 is carried coaxially of the umbilical and comprises a rigid body portion 25, a tapered flexible bend restrictor 26 attached to, and extending from, the upper end of the rigid body portion and a body extension 27 attached to, and extending from the lower end of the rigid body portion.

The component parts of the foundation member are formed in two segments each having a longitudinally extending semi-cylindrical groove 28. The segments are arranged around the umbilical with the umbilical located in the groove 28 and secured to each other in order to form the foundation member and to clamp it into frictional engagement with the surface of the umbilical. If the umbilical, or other flexible elognate member, has a 'soft' external sheath, such as a plastics material, the surface of the locating groove 28 may be roughened or otherwise contoured, for instance by grooves extending transversely to its length, in order to obviate longitudinal slippage between the foundation member and umbilical due to the application of longitudinally acting forces to the foundation member in excess of the effective weight of the deployed umbilical.

The resistance to slippage is in practice a function of clamping pressure and area of contact. In the case of a control umbilical as herein described with such a 'soft' protective sheath of plastics material the permissible clamping pressure must be limited to avoid damage to the internal components of the unbilical and in this respect the overall area of contact, that is, in effect the length of the foundation member, is chosen to satisfy this criterion.

Although the component segments of the foundation member are shown in FIG. 2 separated in order to illustrate clearly the manner in which they are secured to each other around the umbilical it is more convenient to continue description of them in assembled form.

The rigid body portion 25 comprises a cylindrical body of stainless steel having a downwardly facing tapered shoulder portion 29. The annular upper and lower ends 30 and 31, respectively of the body portion are each tapped with a series of fixing holes 32 for corresponding mounting holes 33 of the bend restrictor and body extension respectively.

The assembled bend restrictor 26 comprises an externally tapered body 34 of flexible plastics material, such as polypropylene moulded onto an attachment ring 35 for securing to the upper end 30 of the rigid body portion. The taper of the moulding is primarily to control the radius of curvature of any bending of the umbilical near to the foundation member in accordance with its construction but also it 'streamlines' the profile of the foundation member to prevent it fouling, or being fouled by, other bodies.

The assembled body extension 27 comprises a body also formed of such plastics material moulded onto an attachment ring 36 for securing to the lower end 31 of the rigid body portion. The body extension is preferably tapered to effect a similar streamlining effect to the bend restrictor against fouling and may be formed of a similar flexible material in order to provide bend restriction properties adjacent the lower end of the foundation member. The principle purpose of the body extension is to control the contact area between the foundation member surface that is, groove 28, and the umbilical in order to spread the loading between foundation member and umbilical to give adequate frictional engagement for lifting without damage to the umbilical. In this respect it will be appreciated that the body extension may be formed of a rigid material, similar to the body portion 25 or indeed may be omitted altogether with the length of the body portion 25 chosen to fullfil the contact area requirements.

Referring now to FIGS. 1(*a*) and 3, the lifting member 22 is segmented and comprises a pair of semi-cylindrical segments 40, 41 hinged together along one longitudinal junction by hinge 42 and fastenable to each other along the other longitudinal junction by releasable fastening members, such as swing bolts 43, associated with mating flanges 44.

The lifting member is arranged to be brought to the umbilical at an accessible point above the lifting point (at which the foundation member is clamped) with the segments open as shown in FIG. 3 whereupon the flanges 44 are fastened to each other to define an annular carrier enclosing the umbilical as shown in FIG. 1(*a*).

The assembled lifting member comprises a carrier for support means 45 which comprises in each segment a radially movable support member 46 connected by actuating rod 47 to actuation means 48 in the form of a piston 49 contained in a cylinder 50. Hydraulic fluid feed lines 51, 52 connect opposite ends of the cylinder with support control means. The support control means shown at 53 is located remotely from the lifting member, for example, with the lifting mechanism 23 to be described later, but its operation is conveniently described here. The support control means comprises a source of pressurised hydraulic fluid, such as a pump 54 which provides fluid on line 54 to a manually positionable flow control valve 55. The valve has connections to the aforementioned lines 51 and 52 and to a sump line 56. The valve is rotatable between three angular positions 45° apart. In the central position shown both lines 51 and 52 are closed creating a fluid lock in the cylinder 50 thereby locking the actuation rod 47 and support member 46 in position. If the valve is rotated through 45° clockwise the source 54 is connected to line 52 and the line 51 is connected as a return to the sump so that the piston 49 is driven to the rear of the cylinder and the support member retracted in a radially outward movement, being locked in that position by return of the valve to its central position. Rotation of the valve through 45° anti-clockwise connects the source 53 with line 51 and the line 52 is returned to the sump, or causing the piston 49 to be moved forward in the cylinder, moving the support member radially inwards. Return of the valve to the central position locks the piston, and thus the support member in that position.

It will be appreciated that the hydraulic lines of the actuation means associated with each lifting member segment are connected to the valve 55 or a duplicate valve to be operated together.

Each support member 46 comprises a semicylindrical body of smaller radius than the lifting member segment which carries it and the member are arranged to abut each other at faces 48 when moved inwardly by their respective actuation to define a support seat.

The opposing faces of the support members are each profiled as shown at 57 to form a downwardly tapering frusto-conical aperture, the taper of which substantially corresponds to that of the shoulder 29 of the foundation member, and comprises the support seat. The lower, smaller aperture 58 is of slightly larger radius than the umbilical and body extension 27.

The distance of radial movement of the support members is chosen such that when moved fully outwards the separation between their abutting faces is greater than the diameter of the body portion of the foundation member.

The support means is thus able to define two operational states, conveniently called an open-aperture state, when the seating members are separated as shown in FIG. 1(*a*) and the aperture defined by the annular lifting member is larger than body portion of the foundation member, and a closed-aperture state, when the seating members are together as shown in FIG. 1(*b*) and the aperture defined by the annular lifting member is smaller than body portion of the foundation member.

The segments 40, 41 of the lifting member 22 have suspension eyes 59, 60 respectively by which the lifting member 22 is raised and lowered by the lifting mechanism 23 shown in FIGS. 4 and 5 to which reference is now made.

FIG. 4 shows an umbilical deployment arrangement in which a flexible reinforced umbilical 10 as described above, is deployed by winching from a storage reel 61 which thus forms an initial suspension point for the freely hanging umbilical. During deployment the foundation member 21 is clamped to the umbilical at a predetermined lifting point which is eventually separated from the initial suspension point by a predetermined length L of the umbilical. It is desired at some point in operation to alter the mode of umbilical suspension by suspending it from a constant tension device 62 which maintains a constant tension in the suspended umbilical by varying the position of the suspension point to counteract vessel motion.

The form of constant tension device shown includes a reciprocable subsidiary winch 63 and winch cable 64 suspended from pulley 65 and conveniently provides the lifting mechanism 23 for the lifting member 22 to which the winch cable is attached by suspension eyes 59, 60.

The hydraulic lines 51, 52 controlling the actuation means are separately suspended from pulley 66 and coupled to the support control means 53.

Considering operation of the lifting system with reference to FIGS. 1(*a*) to (*c*), the lifting member is initially brought to the umbilical at an accessible point above the lifting point with the segments open (as shown in FIGS. 3 and 4) and the flanges 44 fastened to each other to define an annular support means carrier enclosing the umbilical. The support means is caused to assume its open-aperture state as shown in FIG. 1(*a*) by manual operation of the support control means 53.

The lifting member 22 is then lowered by the subsidiary winch 63 forming the lifting mechanism, permitting the lifting member to slide down the umbilical. The streamlined profile if the foundation member and the open-aperture state of the support means permit the lifting member to slide past the foundation member to an arbitrary location below it where, as shown in FIG. 2(*b*), the support means is caused to assume its closed-aperture state by manipulation of the support control means 53.

The lifting member is then raised by the winch 63 of the lifting mechanism and slides relatively to the umbilical which readily passes through the aperture in the support seat formed by the abutting support members. The body extension 27, if present, also passes through the support means but when the profiled faces of the support members abut the tapered shoulder 29 of the body as shown in FIG. 1(*c*) such relative motion is prevented and the foundation member, and umbilical, is lifted by the lifting member as the lifting mechanism continues to raise it.

The lifting member is raised by the subsidiary winching means to a typical position as shown in FIG. 5, the lifting member supporting the umbilical at the lifting point which now becomes a suspension point for the deployed length of umbilical hanging from it.

The portion of umbilical between the foundation member and the initial suspension point provided by reel 61, that is, the length L, is freely deployed between the lifting point and the reel and adopts a curvature in accordance with its flexibility and the restraint of bend restriction means 26.

The support control means 53 also configures the lifting mechanism as a constant tension device by sensing the tension in the suspended umbilical, e.g. by a force transducer 67 on the pulley 65, and reciprocating the subsidiary winch 63 to raise and lower the lifting member 22, and therefore the lifting point, to maintain the tension in the umbilical substantially constant.

FIG. 5 shows mid and extreme positions of lifting point displacement and illustrates the continuous flexing of the umbilical adjacent the upper end of the lifting member which is controlled by the bend restriction means of the foundation member. It will also be seen that as the axis of the lifting member and foundation member are supported substantially vertically and the umbilical is maintained in tension the portion of the umbilical adjacent the lower end of the foundation member is subject to little lateral flexing and does not require the same degree of bend restriction as the upper end.

However the umbilical may be subjected to flexing by external laterally acting forces and if desired the body extension 27 may provide bend restriction properties as outlined above.

It will also be appreciated that when the foundation member is supported by the seat formed by support members 46 the cooperating tapered faces centralise the foundation member and the umbilical with respect to the axis of the lifting member such that as it is raised substantially vertically the vertical lifting forces are transfered to the foundation member longitudinally of the umbilical and therefore to the umbilical only by the distributed frictional clamping engagement.

Although it is convenient to provide the rigid body of the foundation member and the support members with corresponding tapered abutment faces it will be appreciated that other profiles may be chosen for either or both to achieve the longitudinally directed support function and preferably centralisation within the lifting member.

To lower the umbilical to its original or any other position the lifting member, supporting the foundation member, is lowered until the umbilical is suspended freely and the load taken from the support members. This may most readily be determined by observing the lifting member moving away from the foundation member. The support means is then caused to assume its open-aperture state and the lifting member is raised past the foundation member to an accessible point at which the two segments of the lifting member are split enabling it to be driven clear of the umbilical.

The use of a separate lifting member and foundation member enables the umbilical to be deployed in free suspension without any impediments caused by a permanently attached lifting mechanism and the "streamlined" profile of the foundation member, which although permanently attached to the umbilical, minimises any increase in the liklihood of fouling between the deployed umbilical and any other equipment.

The foundation member can be constructed to provide support properties tailored to the construction of the umbilical and a plurality of such members can be secured at a plurality of possible lifting points.

Furthermore, the ability to attach the lifting member to the umbilical other than the end of the umbilical or at an accessible location the lifting point and then remotely to support the umbilical at the lifting point enables the lifting system to be operated in circumstances, such as heavy sea-states, where direct connection of the lifting member to the umbilical at the lifting point would be dangerous or difficult.

It will be appreciated that within the operating requirements of the lifting system many of the individual components described above may be replaced by alternatives.

The lifting member may be formed from more than two segments which are secured to each other to provide the support means carrier. Preferably, each segment carries support means and actuation means but this is not necessary provided the movable support members provide a suitable support seat. The two segments shown may be fastened to each other by releasable means at each longitudinal edge to replace the hinge 42 or alternatively, where there are more than two segments, all but one of the longitudinal joints may be hinged.

Other modifications may be made in respect of the support means. The actuation means may be other than hydraulic, such as provided for example by an electric or other motor geared to the actuation rod by a worm and wheel gear. Also the support members may be moved radially by means other than the actuation means shown which protrudes radially of the lifting member.

Referring to FIGS. 6(*a*) and 6(*b*) these show respectively sectional elevations and perspective views similar to FIGS. 1(*a*) and 3 but the support means comprises in each segment of the lifting member radially movable support members 70 which rest in inwardly turned flanges 71 of the segment. The outer peripheral wall 72 of each support member adjacent the cylindrical wall of the lifting member is tapered such that it slopes away from the lifting member wall with distance from flange 71. The actuation means 73 comprises semi-cylindrical wedging member 74 coaxial with the cylindrical wall and located adjacent the inner surface thereof slidable longitudinally of the clamping member. The actuation means comprises a hydraulic piston and cylinder arrangement 75, as described above, the piston being connected to a reciprocable actuation rod 76 which is connected to the wedging member 74. The wedging member is tapered in thickness and extends between the cylindrical wall of the lifting member and tapered surface 72 of the support member such that the tapered surfaces cooperate and cam action translates the longitudinal motion of the actuation rod 75 into radial motion of the support member. A resilient arrangement, such as a spring, (not shown) may be included to exert a radially outward bias force on the support member to withdraw it when the wedging member is raised.

Yet another alternative construction is shown in FIGS. 7(*a*) and (*b*) which respectively show similar sectional elevation and perspective views. In this arrangement the lifting member and actuation means is similar to that described above in relation to FIG. 6 but in each segment of the lifting member the single semi-cylindrical support member is replaced by a semi-circular array of loosely coupled dogs 77. The dogs are retained in the segment of the lifting member by conventional restraining and biasing means not shown. In operation the individual dogs are biased radially inwardly by downward motion of the wedging member 74 to abut each other and corresponding ones of other lifting member sgements to form the support seat. A further modification shown in this Figure is that dogs 77, as well as having an upwardly tapering surface 78 which compliments the tapered portion 29 of the foundation member, also have a face 79 which engages with the cylindrical wall of the rigid portion of the foundation member providing both lateral support of the foundation member in relation to the lifting member as well as lifting support extended longitudinally of the umbilical.

The constructions given for the support means serve to illustrate the variety of forms such means may take. The use of symmetrically disposed support members has the effect of tending to centralise the elongate member and possibly the foundation member with respect to the lifting member. However it will be seen that the support means could also be formed with a fixed support member in one of the lifting member segments and one or more movable support member in the other lifting member segment or segments.

The construction of the foundation member as described may be varied. For instance the rigid body portion may be formed of other than the stainless steel material considered suitable for operation in a saline environment and other metallic or even plastics materials having suitable strength may be used. Similarly, alternative materials may be employed for the bend restrictor and body extension, if the latter is used. Also the formation of a cylindrical body portion with a tapered shoulder is convenient in respect of assembly and a shape which facilitates both seating in the support means and passage through the annular lifting means. However, the profile of the body portion may be chosen differently providing these considerations are met. The components of the foundation member may be formed of more than two segments secured to each other about the umbilical or may be hinged to facilitate application and removal. Also, alternative conventional methods may be employed to secure the component parts and segments thereof together or the foundation member may be secured to some anchor point moulded into, or may itself be moulded in a single piece into an umbilical or secured thereto on a permanent basis with adhesive.

An alternative construction of foundation member is shown in the partly sectional elevation view of FIG. 8 at 80.

The vertically hanging umbilical 10 carries a rigid body, shown at 81, having an external appearance similar to that of the portion 25 described above and in particular has a tapered shoulder portion 82 corresponding to the shoulder portion 29 of FIG. 1 for locating abutment with the lifting member (not shown). The body portion 81 is not however clamped to the surface of the umbilical but is slidable along it. Attached to the lower end of the body portion 81 and clamp 83, fixed in position around the umbilical, are a plurality of flexible elongate filaments 84, said filaments being braided with each other about the umbilical to form a so-called Chinese finger device. This operates in conventional manner such that as the body portion is moved away from the clamp 83 the filaments grip against the surface of the umbilical and effectively clamp the body portion 81 in position on the umbilical. Such movement of the body portion 81 is achieved in practice by it being lifted by the lifting member whereby as the clamping action of the filaments become effective, the umbilical is lifted also.

It will be appreciated that the combination of body portion 81 and braided filaments 84 corresponds to the combination of clamped body member and body extension 25 and 27 respectively of FIG. 1 but with the advantage that this arrangement operates dynamically in that the clamping force of the foundation member against the umbilical is only as great as is required to cause the umbilical to lift with the foundation member and, irrespective of any variations in operation need not be determined in advance.

It will be appreciated that in operation the body portion will slide as far as is necessary for the filaments to exert the required clamping force. However, should the suspended umbilical be fouled in some way that it does not lift then continued increase of clamping pressure could damage the umbilical structure. To prevent this an upper stop 85 may be clamped to the umbilical to limit the displacement of the body portion from the lower clamp 83, and thus the maximum clamping force on the umbilical.

A flexible bend restrictor 86 corresponding to the restrictor 26 of FIG. 1 may be secured to the upper end of the body portion 81, and be slidable along the umbilical with it. Conveniently the upper portion of the body portion is recessed, as shown at 86 to accommodate the stop when in abutment with it. If the body portion normally moves to such position that it invariably abuts the stop then the stop may comprise the end of a bend restrictor clamped to the umbilical as shown in FIGS. 1 and 2.

Alternatively, the arrangement may be operated as a static arrangement, that is, with a fixed clamping force, by applying an along-member force to the rigid body portion until a predetermined clamping force is achieved between the filaments and the umbilical and then clamping the rigid body portion to the umbilical to retain the clamping status of the filaments. The bend restrictor may then be secured to the rigid body portion and clamped to the umbilical. The resultant arrangement may be seen as a direct analogue of that shown in FIG. 1.

Other modifications may be envisaged, for example, in relation to the lifting mechanism in which a winch and cable, from which the lifting member is suspended, is replaced by a ram or other support arm for the lifting member and which may be movable in any orientation.

Finally it will be appreciated that the lifting system of the present invention is not limited to use with a control umbilical associated with marine equipment and having the properties or handling requirements referred to above. Providing the clamping requirements with the foundation member are met the system may be used with any suspended flexible elongate member which has to be lifted from some lifting point below its initial suspension point. The elongate member need not be hanging vertically although it will be appreciated that any departure from the vertical will cause lateral forces to be exerted between the lifting member and the flexible elongate member at the lifting point unless the lifting member is raised, not vertically, but along the longitudinal axis of the elongate member. The presence of any significant vertical directional component of the suspended member will permit the positioning of the lifting member by sliding the assembled carrier along the member.

I claim:

1. A lifting system for a suspended flexible elongate member including at least one foundation member, having a rigid body portion, adapted to be carried coaxially surrounding and clamped to, the elongate member at a listing position thereof, a removable segmented lifting member adapted to be assembled from segments thereof coupled around the elongate member at a point intermediate it ends to form an annular apertured carrier of support means, including at least one support member movable radially outwardly in the carrier to define an open-aperture state through which the flexible elongate member and the foundation member can pass and movable radially inwardly in the carrier to define a closed-aperture state through which the flexible elongate member, but not the rigid body portion of the foundation member, can pass, and a lifting mechanism operable to lift the lifting member, with the support means in the closed-aperture state, from below the foundation member, abutment between the support means and the rigid body portion of the foundation member causing the foundation member, and a flexible elongage member to which it is clamped, to be lifted with the lifting member.

2. A lifting system as claimed in claim 1 in which the rigid body portion of each foundation member has a downwardly facing shoulder portion extending circumferentially of the elongate member and arranged to be contacted by the support means of the lifting member.

3. A lifting system as claimed in claim 2 in which the shoulder portion is tapered between the wall of the rigid body portion and the elongate member in order to centralise it with respect to the closed state aperture of the lifting member upon engagement with the support means thereof.

4. A lifting system as claimed in claim 1 in which the rigid body portion of the foundation member is formed of stainless steel.

5. A lifting system as claimed in claim 1 in which the foundation member includes flexible bend restriction means extending from at least the upper end of the rigid body portion in its operational position and so as to limit the radius of curvature of flexing of the member in the vicinity of the foundation member.

6. A lifting system as claimed in claim 1 in which the foundation member includes an extension of the rigid body portion extending along a portion of the flexible elongate member and adapted to clamp against the surface of the flexible elongate member with such frictional engagement between the body extension and the flexible elongate member that the flexible elongate member is lifted upon lifting of the body portion.

7. A lifting system as claimed in claim 6 in which the body extension comprises a body adapted to be clamped into engagement with and enclose the flexible elongate member along the whole of said portion of flexible elongate member.

8. A lifting system as claimed in claim 6 in which the body extension comprises a plurality of flexible elongate filaments attached to the body portion and extending downwardly therefrom at points around the flexible elongate member, said filaments being braided with each other around the flexible elongate member along said portion of its length such that the filaments exert a clamping force on the flexible elongate member.

9. A lifting system as claimed in claim 8 in which the rigid body portion is slidable along the flexible elongate member, and the clamping force exerted by the filaments on the flexible elongate member is related to movement of the body portion along the flexible elongate member effected by the lifting member.

10. A lifting system as claimed in claim 1 in which the body portion is adapted to be clamped into engagement with the flexible elongate member.

11. A lifting system as claimed in claim 1 in which each body of the foundation member clamped to the flexible elongate member is formed of longitudinally extending segments, arranged to be secured to each other, disposed around the elongate member so as to frictionally engage the elongate member and transfer the lifting force from the foundation member to the elongate member without slippage.

12. A lifting system as claimed in claim 11 in which said inner surface of the foundation member arranged to contact with the elongate member is contoured to improve contact with the elongate member.

13. A lifting system as claimed in claim 1 in which the lifting member comprises a pair of semi-cylindrical segments hinged together along one longitudinal junction and fastenable to each other along the other longitudinal junction and in which the support members are semi-cylindrical and arranged to clamp against each other and are profiled to define a frusto-conical support seat, tapering inwardly and downwardly with respect to the lifting member and conforming to a corresponding profile of at least the lower portion of the rigid body portion of the foundation member.

14. A lifting system for a suspended flexible elongate member including at least one foundation member, having a rigid body portion, adapted to be carried coaxially surrounding, and clamped to, the elongate member at a lifting position thereof, a removable segmented lifting member adapted to be assembled around the elongate member to form an annular apertured carrier of support means, said support means including in each segment at least one radially movable support member and actuation means operable to cause each said movable support member to be moved to a radially outward position in the carrier to define an open-aperture state through which the flexible elongate member and the foundation member can pass and operable to cause each said movable support member to be moved to a radially inwardly position in the carrier to define a closed-aperture state through which the flexible elongate member, but not the rigid body portion of the foundation member, can pass and support control means operable remotely of the lifting member to control operation of the actuation means to define the aperture state of the support means, and a lifting mechanism operable to lift the lifting member, with the support means in the closed-aperture state, from below the foundation member, abutment between the support means and the rigid body portion of the foundation member causing the foundation member, and a flexible elongate member to which it is clamped, to be lifted with the lifting member.

15. A lifting system as claimed in claim 14 in which the actuation means comprises a hydraulic piston and cylinder arrangement responsive to pressurised hydraulic fluid applied thereto to move and maintain the radial positions of said support members.

16. A lifting system as claimed in claim 14 in which said support members are arranged to be clamped against each other to define in the closed aperture state a support seat apertured for the passage of said elongate member.

17. A lifting system as claimed in claim 16 in which the support control means comprises remotely of the lifting member a source of pressurised hydraulic fluid and manually operable control valve means connected to control the flow of fluid to the actuation means of the lifting member, said control valve means being configured to supply fluid to the actuation means to displace each associated support member or to lock it in position.

18. A method of lifting a suspended flexible elongate member at a lifting point below its suspension point by means of a lifting system including at least one foundation member, having a rigid body portion adapted to be carried coaxially surrounding, and clamped to, the elongate member at a lifting position thereof, a removable segmented lifting member adapted to be assembled around the elongate member to form an annular apertured carrier of support means, including at least one support member movable radially outwardly in the carrier to define an open-aperture state through which the flexible elongate member and the foundation member can pass and movable radially inwardly in the carrier to define a closed-aperture state through which the flexible elongate member, but not the rigid body portion of the foundation member, can pass, and a lifting mechanism operable to lift the lifting member, said method comprising clamping a foundation member to the elongate member at a desired lifting point during deployment of the elongate member, assemblying the lifting member around the elongate member at a position between the suspension point and the lifting point with the support means in an open-aperture state, sliding the lifting member down the elongate member to a position below the foundation member, causing the support means to assume a closed-aperture state and then raising the lifting member, abutment between the support means and the rigid body portion of the foundation member causing the foundation member and elongate member to be lifted with the lifting member.

* * * * *